US008773324B2

(12) United States Patent
Ozden et al.

(10) Patent No.: US 8,773,324 B2
(45) Date of Patent: Jul. 8, 2014

(54) APPARATUS, METHOD AND COMPUTER PROGRAM FOR WIRELESS COMMUNICATION

(75) Inventors: Sinasi Ozden, Soborg (DK); Richard Breiter, Fredriksberg (DK)

(73) Assignee: Nokia Corporation, Espoo (FI)

( * ) Notice: Subject to any disclaimer, the term of this patent is extended or adjusted under 35 U.S.C. 154(b) by 661 days.

(21) Appl. No.: 13/001,108

(22) PCT Filed: Jun. 26, 2008

(86) PCT No.: PCT/EP2008/058212

§ 371 (c)(1),
(2), (4) Date: Feb. 22, 2011

(87) PCT Pub. No.: WO2009/155984

PCT Pub. Date: Dec. 30, 2009

(65) Prior Publication Data

US 2011/0140982 A1 Jun. 16, 2011

(51) Int. Cl.
*H01Q 1/50* (2006.01)

(52) U.S. Cl.
USPC ..... 343/860; 343/850; 343/853

(58) Field of Classification Search
USPC ..... 343/702, 850, 853, 860, 861
See application file for complete search history.

(56) References Cited

U.S. PATENT DOCUMENTS

| | | | | |
|---|---|---|---|---|
| 1,667,792 | A * | 5/1928 | Martin | 342/367 |
| 3,132,339 | A * | 5/1964 | Boughnou | 342/102 |
| 3,895,304 | A | 7/1975 | Klein | 328/167 |
| 4,072,956 | A * | 2/1978 | Provencher | 343/844 |
| 6,243,052 | B1 * | 6/2001 | Goldstein et al. | 343/895 |
| 2004/0127178 | A1 | 7/2004 | Kuffner | 455/133 |
| 2004/0204189 | A1 | 10/2004 | Guetre et al. | 455/575.1 |
| 2007/0142014 | A1 | 6/2007 | Wilcox | 455/276.1 |
| 2011/0175789 | A1 * | 7/2011 | Lee et al. | 343/853 |

FOREIGN PATENT DOCUMENTS

| | | | |
|---|---|---|---|
| EP | 0 441 500 | A2 | 1/1991 |
| EP | 1 152 254 | A2 | 11/2001 |
| JP | 2006108824 | A | 4/2006 |

* cited by examiner

*Primary Examiner* — Tho G Phan
(74) *Attorney, Agent, or Firm* — Harrington & Smith

(57) ABSTRACT

An apparatus including: a first antenna operable in a first resonant frequency band; a second antenna operable in a second resonant frequency band; a first filter coupled to the second antenna; and a first phase shifter configured to provide the combination of at least the first filter and the second antenna with an impedance at the first resonant frequency band which substantially suppresses coupling between the first antenna and the second antenna.

20 Claims, 5 Drawing Sheets

APPARATUS, METHOD AND COMPUTER PROGRAM FOR WIRELESS COMMUNICATION

FIELD OF THE INVENTION

Embodiments of the present invention relate to an apparatus, method and computer program. In particular, they relate to an apparatus, method and computer program in a mobile cellular telephone.

BACKGROUND TO THE INVENTION

Apparatus, such as portable communication devices (e.g. mobile cellular telephones) usually include two or more antennas which enable the apparatus to communicate on multiple radio frequency bands and/or protocols. However, since such apparatus are relatively small, the antennas are usually positioned relatively close to one another and can suffer from interference arising from electromagnetic coupling between the antennas. This may result in poor signal transmission/reception at the antennas and/or increased energy consumption by the apparatus.

It would therefore be desirable to provide an alternative apparatus.

BRIEF DESCRIPTION OF VARIOUS EMBODIMENTS OF THE INVENTION

According to various, but not necessarily all, embodiments of the invention there is provided an apparatus comprising: a first antenna operable in a first resonant frequency band; a second antenna operable in a second resonant frequency band; a first filter coupled to the second antenna; and a first phase shifter configured to provide the combination of at least the first filter and the second antenna with an impedance at the first resonant frequency band which substantially suppresses coupling between the first antenna and the second antenna.

The apparatus may be for wireless communication.

The combination of the first filter and the second antenna may be configured to form a notch filter having a resonant frequency band, the first phase shifter may be configured to shift the resonant frequency band of the combination to be substantially equal to the first resonant frequency band.

The first phase shifter may be variable. The first phase shifter may be configurable to provide the combination of the first filter and the second antenna with an impedance at a resonant frequency band, selectable from a plurality of resonant frequency bands, which substantially suppresses coupling between the first antenna and the second antenna.

The apparatus may further comprise a third antenna operable at a third resonant frequency band, a second filter coupled to the third antenna and a second phase shifter configured to provide the combination of at least the second filter and the third antenna with an impedance at the first resonant frequency band which substantially suppresses coupling between the first antenna and the third antenna.

The combination of the second filter and the third antenna may be configured to form a notch filter having a resonant frequency band, the second phase shifter may be configured to shift the resonant frequency band of the combination to be substantially equal to the first resonant frequency band.

The second phase shifter may be variable and may be configurable to provide the combination of the second filter and the third antenna with an impedance at a resonant frequency band, selectable from a plurality of resonant frequency bands, which substantially suppresses coupling between the first antenna and the third antenna.

The apparatus may further comprise a controller configured to control the first phase shifter and/or the second phase shifter and to select the resonant frequency band at which coupling between the first antenna and the second antenna, and/or the first antenna and the third antenna respectively is substantially suppressed.

The apparatus may further comprise a multiplexer including the first filter and the second filter. The multiplexer may be a diplexer.

The second filter may be a high pass filter. The first filter may be a low pass filter. The first phase shifter may be integral with the first filter. The first filter may provide the functionality of the first phase shifter.

The first resonant frequency band may be a Global Navigation Satellite System (GNSS) frequency band.

According to various, but not necessarily all, embodiments of the invention there is provided a method comprising: providing a first antenna operable in a first resonant frequency band, a second antenna operable in a second resonant frequency band, a first filter coupled to the second antenna, and a first phase shifter; and configuring the first phase shifter to provide the combination of at least the first filter and the second antenna with an impedance at the first resonant frequency band which substantially suppresses coupling between the first antenna and the second antenna.

The method may further comprise configuring the combination of the first filter and the second antenna to form a notch filter having a resonant frequency, the first phase shifter may be configured to shift the resonant frequency band of the combination to be substantially equal to the first resonant frequency band.

The first phase shifter may be variable. The method may further comprise configuring the first phase shifter to provide the combination of the first filter and the second antenna with an impedance at a resonant frequency band, selectable from a plurality of resonant frequency bands, which substantially suppresses coupling between the first antenna and the second antenna.

The method may further comprise providing a third antenna operable at a third resonant frequency band, a second filter coupled to the third antenna and a second phase shifter. The method may further comprise configuring the second phase shifter to provide the combination of at least the second filter and the third antenna with an impedance at the first resonant frequency band which substantially suppresses coupling between the first antenna and the third antenna.

The method may further comprise configuring the combination of the second filter and the third antenna to form a notch filter having a resonant frequency band, the second phase shifter may be configured to shift the resonant frequency band of the combination to be substantially equal to the first resonant frequency band.

The second phase shifter may be variable. The method may further comprise configuring the second phase shifter to provide the combination of the second filter and the third antenna with an impedance at a resonant frequency band, selectable from a plurality of resonant frequency bands, which substantially suppresses coupling between the first antenna and the third antenna.

The method may further comprise providing a controller configured to control the first phase shifter and/or the second phase shifter and to select the resonant frequency band at which coupling between the first antenna and the second antenna, and/or the first antenna and the third antenna respectively is substantially suppressed.

The method may further comprise providing a multiplexer including the first filter and the second filter.

The second filter may be a high pass filter. The first filter may be a low pass filter. The first phase shifter may be integral with the first filter. The first filter may provide the functionality of the first phase shifter.

The first resonant frequency band may be a Global Navigation Satellite System (GNSS) frequency band.

According to various, but not necessarily all, embodiments of the invention there is provided a portable electronic device comprising an apparatus as described in any of the preceding paragraphs.

According to various, but not necessarily all, embodiments of the invention there is provided a method comprising: controlling a first phase shifter to provide a combination of a first filter and a second antenna, coupled to first filter, with an impedance at a resonant frequency band, selectable from a plurality of resonant frequency bands, which substantially suppresses coupling between a first antenna and the second antenna.

The first antenna may be operable in a first resonant frequency band. The method may include controlling the first phase shifter to provide the combination of the first filter and the second antenna with an impedance at the first resonant frequency band which substantially suppresses coupling between the first antenna and the second antenna.

According to various, but not necessarily all, embodiments of the invention there is provided a computer-readable storage medium encoded with instructions that, when executed by a processor, perform: controlling a first phase shifter to provide a combination of a first filter and a second antenna, coupled to first filter, with an impedance at a resonant frequency band, selectable from a plurality of resonant frequency bands, which substantially suppresses coupling between a first antenna and the second antenna.

The first antenna may be operable in a first resonant frequency band. The method may include controlling the first phase shifter to provide the combination of the first filter and the second antenna with an impedance at the first resonant frequency band which substantially suppresses coupling between the first antenna and the second antenna.

According to various, but not necessarily all, embodiments of the invention there is provided a computer program that, when run on a computer, performs: controlling a first phase shifter to provide a combination of a first filter and a second antenna, coupled to first filter, with an impedance at a resonant frequency band, selectable from a plurality of resonant frequency bands, which substantially suppresses coupling between a first antenna and the second antenna.

The first antenna may be operable in a first resonant frequency band. The method may include controlling the first phase shifter to provide the combination of the first filter and the second antenna with an impedance at the first resonant frequency band which substantially suppresses coupling between the first antenna and the second antenna.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 1:
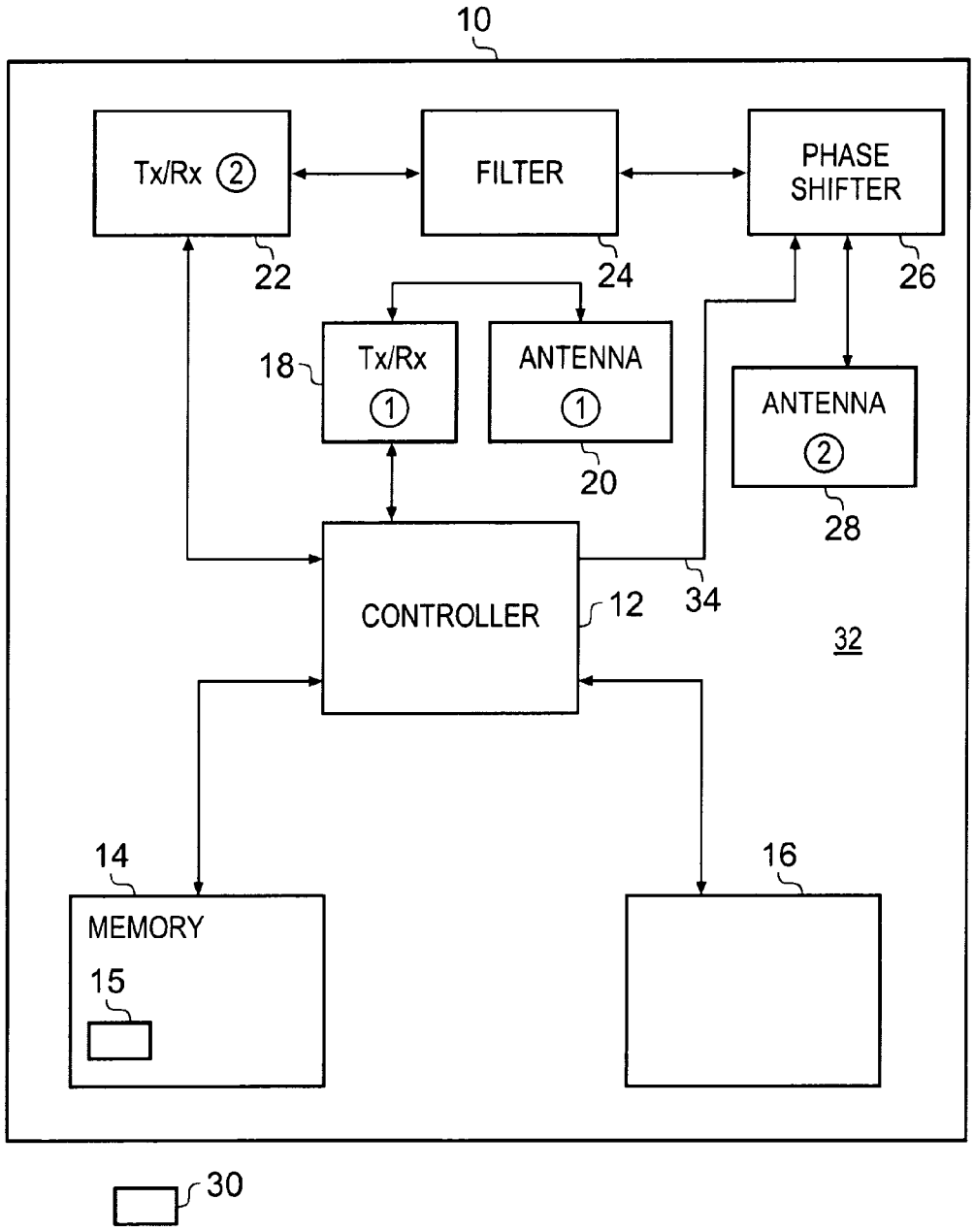
FIG. 1 illustrates a schematic diagram of an apparatus according to various embodiments of the present invention.
Figure 2:
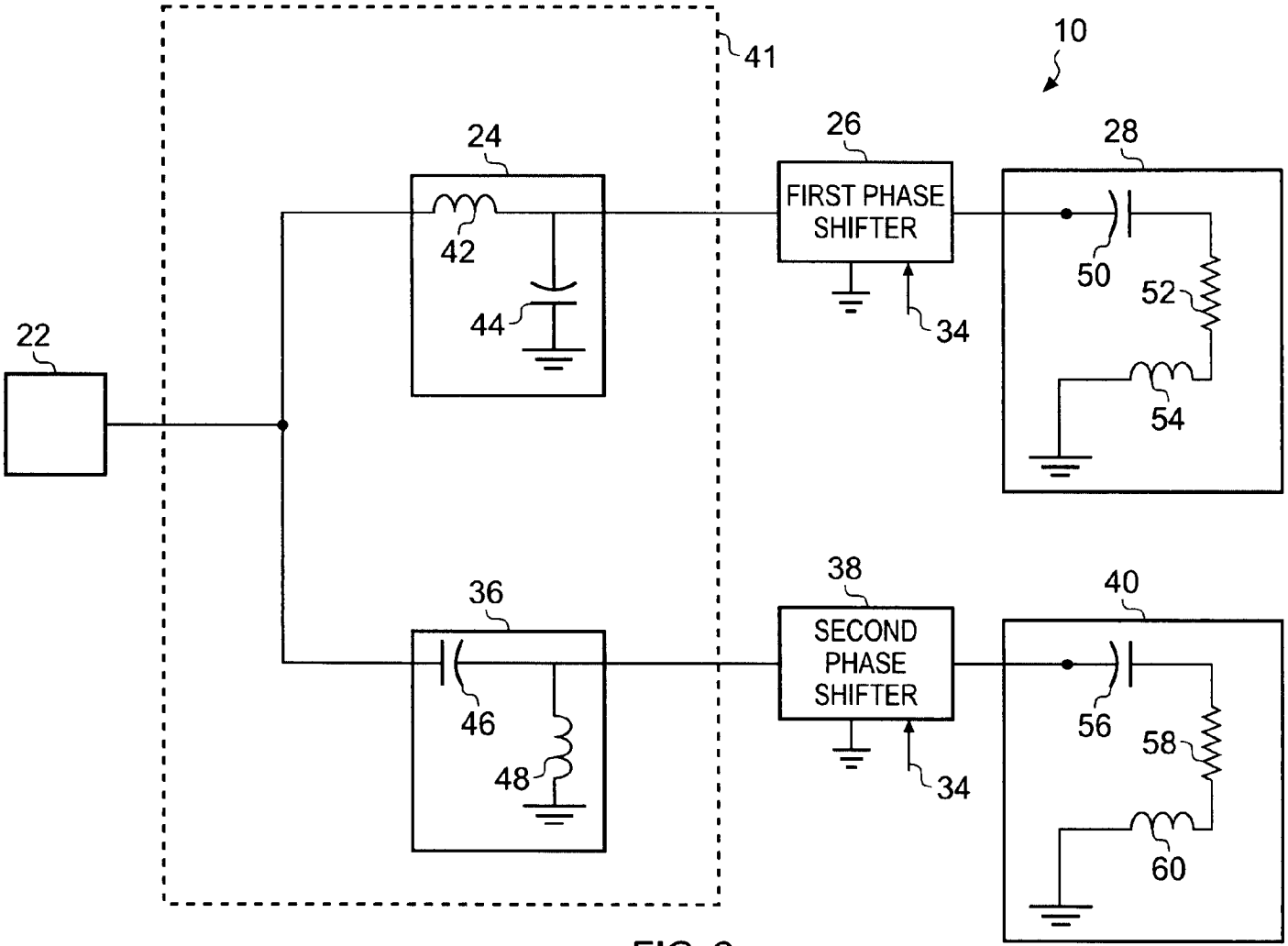
FIG. 2 illustrates a schematic diagram of an apparatus according to various embodiments of the present invention.

FIGS. 1 and 2 illustrate an apparatus 10 comprising: a first antenna 20 operable in a first resonant frequency band; a second antenna 28 operable in a second resonant frequency band; a first filter 24 coupled to the second antenna 28; and a first phase shifter 26 configured to provide the combination of at least the first filter 24 and the second antenna 28 with an impedance at the first resonant frequency band which substantially suppresses coupling between the first antenna 20 and the second antenna 28.

In more detail, FIG. 1 illustrates an apparatus 10 which includes a controller 12, a memory 14, other (optional) circuitry 16, a first transceiver 18, a first antenna 20, a second transceiver 22, a filter 24, a phase shifter 26 and a second antenna 28.

In the following description, the wording 'connect' and 'couple' and their derivatives mean operationally connected/coupled. It should be appreciated that any number or combination of intervening components can exist (including no intervening elements). Additionally, it should be appreciated that the connection/coupling may be a physical galvanic connection and/or an electromagnetic connection.

Additionally, in the following description it should be appreciated that where an antenna is mentioned as being operable in a resonant frequency band, it should be understood to mean that the antenna is operable in a frequency band over which the antenna can efficiently operate. Efficient operation occurs, for example, when the antenna's insertion loss S11 is greater than an operational threshold such as 4 dB or 6 dB The apparatus 10 may be any electronic device and may be, for example, a portable electronic device such as a mobile cellular telephone, a personal digital assistant (PDA), a laptop computer, a palm top computer, a portable WLAN or WiFi device, or module for such devices. As used here, 'module' refers to a unit or apparatus that excludes certain parts/components that would be added by an end manufacturer or a user.

In the embodiment where the apparatus 10 is a mobile cellular telephone, the other circuitry 16 includes input/output devices such as a microphone, a loudspeaker, keypad and a display. The electronic components that provide the controller 12, the memory 14, the other circuitry 16, the first transceiver 18, the first antenna 20, the second transceiver 22, the filter 24, the phase shifter 26 and the second antenna 28 may be interconnected via a printed wiring board (PWB) 32 which may serve as a ground plane for the first antenna 20 and for the second antenna 28. In various embodiments, the printed wiring board 32 may be a flexible printed wiring board.

The implementation of the controller 12 can be in hardware alone (e.g. a circuit, a processor . . . ), have certain aspects in software including firmware alone or can be a combination of hardware and software (including firmware).

The controller 12 may be implemented using instructions that enable hardware functionality, for example, by using executable computer program instructions in a general-purpose or special-purpose processor that may be stored on a computer readable storage medium (e.g. disk, memory etc) to be executed by such a processor.

The controller 12 is configured to read from and write to the memory 14. The controller 12 may also comprise an output interface via which data and/or commands are output by the controller 12 and an input interface via which data and/or commands are input to the controller 12.

The memory 14 may be any suitable memory and may, for example be permanent built-in memory such as flash memory or it may be a removable memory such as a hard disk, secure digital (SD) card or a micro-drive. The memory 14 stores a computer program 15 comprising computer program instructions that control the operation of the apparatus 10 when loaded into the controller 12. The computer program instructions 15 provide the logic and routines that enables the apparatus 10 to perform the method illustrated in FIG. 5. The controller 12 by reading the memory 14 is able to load and execute the computer program 15.

The computer program 15 may arrive at the apparatus 10 via any suitable delivery mechanism 30. The delivery mechanism 30 may be, for example, a computer-readable storage medium, a computer program product, a memory device, a record medium such as a CD-ROM or DVD, an article of manufacture that tangibly embodies the computer program 15. The delivery mechanism 30 may be a signal configured to reliably transfer the computer program 15. The apparatus 10 may propagate or transmit the computer program 15 as a computer data signal.

Although the memory 14 is illustrated as a single component it may be implemented as one or more separate components, some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (e.g. Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The controller 12 is coupled to the first antenna 20 via the first transceiver 18. The first transceiver 18 is configured to receive and decode signals received at the first antenna 20 and provide the decoded signals to the controller 12 for processing. The first transceiver 18 is also configured to receive and encode signals from the controller 12 and provide the encoded signals to the first antenna 20 for transmission.

In various embodiments, the first antenna 20 may be any suitable antenna which is operable in at least a first resonant frequency band. For example, the first antenna 20 may be configured to receive Global Navigation Satellite System (GNSS) signals (e.g. GPS signals having a frequency band of 1570.42 MHz to 1580.42 MHz) and provide them to the transceiver 18 for decoding. The first antenna 20 may also be operable in a plurality of different radio frequency bands and/or protocols.

The controller 12 is coupled to the second antenna 28 via the second transceiver 22, the filter 24 and the phase shifter 26. The second transceiver 22 is configured to receive and decode signals received at the second antenna 28 and provide the decoded signals to the controller 12 for processing. The second transceiver 22 is also configured to receive and encode signals from the controller 12 and provide the encoded signals to the second antenna 28 for transmission.

The filter 24 is connected between the second transceiver 22 and the phase shifter 26, and the phase shifter 26 is in turn connected to the second antenna 28. The filter 24 may be any suitable filter for filtering a signal received at, or provided to, the second antenna 28. The filter 24 may be a single electronic component (e.g. an inductor or a capacitor) which may be variable, or may include a plurality of electronic components such as inductors and capacitors which may also be variable.

The filter 24 may be included within a multiplexer such as a diplexer or a triplexer. The filter 24 may be, for example, a low pass filter which attenuates relatively high frequency signals (e.g. a 1800 MHz signal) but does not substantially attenuate relatively low frequency signals (e.g. a 900 MHz signal). Alternatively, the filter 24 may be, for example, a high pass filter which attenuates relatively low frequency signals (e.g. a 900 MHz signal) but does not substantially attenuate relatively high frequency signals (e.g. a 1800 MHz signal). Low pass and high pass filters are well known in the field of electronics and will not be discussed in detail here.

The phase shifter 26 may be any suitable phase shifter for changing the electrical length of the filter 24 and second antenna 28 combination. For example, the phase shifter 26 may be any one of, or include any combination of transmission lines, delay lines, inductors and capacitors. Phase shifters are well known in the field of electronics and will consequently not be discussed in detail here. It should be appreciated that in some embodiments of the present invention, the phase shifter 26 may be integral with the filter 24 and the filter 24 may provide the functionality of the phase shifter 26. For example, if the filter includes a variable reactive component (e.g. a variable capacitor or a variable inductor), the phase shifter 26 may be provided by that variable reactive component. In these embodiments, it may not be necessary to provide a phase shifter, separate from the filter.

The phase shifter 26 may be a variable phase shifter and may be configured to receive a control signal 34 from the controller 12. In various embodiments, the phase shifter 26 may include a plurality of selectable, different, reactive elements and the controller 12 may be configured to select one of the reactive elements by using the control signal 34. For example, the phase shifter 26 may include a plurality of different transmission lines and a switch and the controller 12 may control the switch to connect the second antenna 28 to one of the transmission lines. In this way, the controller 12 may be configured to control the electrical length of the filter 24 and second antenna 28 combination.

The second antenna 28 may be any antenna which is suitable for operation in an apparatus 10 such as a mobile cellular telephone. For example, the second antenna 28 may be a planar inverted F antenna (PIFA), a planar inverted L antenna (PILA), a loop antenna, a monopole antenna or a dipole antenna. The second antenna 28 may also have matching components between the second antenna 28 and the second transceiver 22. These matching components may be lumped components (e.g. inductors and capacitors), transmission lines, or a combination of both. The second antenna 28 is operable in at least a second operational resonant frequency band and may also be operable in a plurality of different radio frequency bands and/or protocols (e.g. GSM, CDMA, and WCDMA).

The first antenna 20 and the second antenna 28 may be positioned in relatively close proximity to one another. For example, they may be located at a distance of 5 mm to 40 mm from one another. Since the first antenna 20 and the second antenna 28 are connected to different transceivers, it should be appreciated that the first antenna 20 and the second antenna 28 do not form an antenna array.

The first antenna 20 and the second antenna 28 may be configured to operate in a plurality of different operational radio frequency bands and via a plurality of different protocols. For example, the different operational frequency bands and protocols may include (but are not limited to) AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz). As mentioned above, an operational frequency band is a frequency range over which an antenna can efficiently operate. Efficient operation occurs, for example, when the antenna's insertion loss S11 is greater than an operational threshold such as 4 dB or 6 dB The phase shifter 26 is configured to provide the combination of at least the filter 24 and the second antenna 28 with an impedance at the first resonant frequency band (e.g. GPS frequency band of 1570.42 MHz to 1580.42 MHz) which substantially suppresses coupling between the first antenna 20 and the second antenna 28.

Embodiments of the present invention may provide an advantage in that they may help reduce coupling between the first antenna 20 and the second antenna 28 at the first resonant frequency band and thereby isolate the second antenna 28 from the first antenna 20. This may result in improved signal transmission/reception at the antennas and/or decreased energy consumption by the apparatus.

The combination of the filter 24 and the second antenna 28 may form a notch filter (also called a band stop filter) which has a (non-radiating) resonant frequency band. It should be appreciated that the resonant frequency band of the notch filter attenuates those frequencies of a signal which lie within the resonant frequency band and does not substantially attenuate those frequencies which are outside of the resonant frequency band. For example, if the resonant frequency band of a notch filter is 800-900 MHz and a signal has a frequency range of 700-1000 MHz, the notch filter attenuates the portion of the signal having frequencies in the range of 800-900 MHz and does not substantially attenuate the portions of the signal having frequencies in the range of 700-800 MHz and 900-1000 MHz.

The phase shifter 26 is configured to tune the resonant frequency band of the notch filter formed by the combination of the filter 24 and the second antenna 28 so that the resonant frequency band of the notch filter is substantially equal to the first resonant frequency band. For example, if the resonant frequency band of the notch filter formed by the filter 24 and second antenna 28 combination is 800-900 MHz and the first resonant frequency band of the first antenna 20 is 1570.42 MHz to 1580.42 MHz (a GPS frequency signal), then the phase shifter 26 may be configured so as to shift the resonant frequency band of the notch filter from 800-900 MHz to 1500-1600 MHz, thereby covering the first resonant frequency band and isolating the second antenna 28 and first antenna 20 from one another.

FIG. 2 illustrates a schematic diagram of an apparatus 10 according to various embodiments of the present invention. The apparatus 10 illustrated in FIG. 2 is similar to the apparatus 10 illustrated in FIG. 1, and where the features are similar, the same reference numerals are used.

In more detail, FIG. 2 illustrates an apparatus 10 including the second transceiver 22, a first filter 24, a first phase shifter 26, a second antenna 28, a second filter 36, a second phase shifter 38 and a third antenna 40. The apparatus 10 may also include other circuitry, such as a controller 12, a memory 14 etc. . . . , however these are not illustrated to maintain the clarity of FIG. 2.

The first filter 24 is, in this example, a low pass filter and includes an inductor 42, connected between the first phase shifter 26 and the second transceiver 22, and a capacitor 44 connected between the inductor 42 and ground. The second filter 36 is, in this example, a high pass filter and includes a capacitor 46, connected between the second phase shifter 38 and the second transceiver 22, and an inductor 48 connected between the capacitor 46 and ground. The first filter 24 and the second filter 36 may be included within a multiplexer 41 such as a diplexer or a triplexer.

As mentioned above, the first phase shifter 26 and the second phase shifter 38 may be any suitable phase shifters for changing the electrical length of the first filter 24, second antenna 28 combination and the second filter 36, third antenna 40 combination respectively. For example, the first and second phase shifters 26, 38 may be any one of, or include any combination of transmission lines, delay lines, inductors and capacitors.

The third antenna 40 may be any suitable antenna for an apparatus 10 such as a mobile cellular telephone. Additionally, the third antenna 40 may be operable in any of the above mentioned operational frequency bands and/or protocols.

The second antenna 28 is connected to the first phase shifter 26 and is operable in a second resonant frequency band (e.g. US GSM 850). The third antenna 40 is connected to the second phase shifter 38 and is operable in a third resonant frequency band (e.g. US WCDMA 1900). In FIG. 2, equivalent circuit diagrams are illustrated for the second antenna 28 and for the third antenna 40. It should be appreciated that these equivalent circuit diagrams represent the second antenna 28 and the third antenna 40 for frequencies outside of the second and third resonant frequency bands respectively and when they have a non fifty ohm impedance.

The second antenna 28 includes a capacitor 50, a resistor 52 and an inductor 54 connected in series with one another. The capacitor 50 is connected to the first phase shifter 26 and the inductor 54 is connected to ground. The third antenna 40 includes a capacitor 56, a resistor 58 and an inductor 60 connected in series with one another. The capacitor 56 is connected to the second filter 38 and the inductor 60 is connected to ground.

The combination of the first filter 24 and the second antenna 28 form a notch filter which has a (non radiating) resonant frequency band (e.g. at 1800 MHz). In particular, the capacitor 44 of the first filter 24 and the inductor 54 of the second antenna 28 form a notch filter having a resonant frequency band. In the embodiment illustrated in FIG. 2, a signal having a frequency within the resonant frequency band of the notch filter 44, 54 goes to ground via the capacitor 44. It should be appreciated that the resonant frequency band of the notch filter may be determined from the capacitance value of the capacitor 44 and from the inductance value of the inductor 54.

The first phase shifter 26 is configured to tune the resonant frequency band of the notch filter 44, 54 to be substantially equal to the first resonant frequency band and thereby suppress coupling between the first antenna 20 and the second antenna 28.

The first phase shifter 26 may be a variable phase shifter which is configured to receive a control signal 34 from the controller 12. In this embodiment, the controller 12 is configured to control the first phase shifter 26 to tune the resonant frequency band of the notch filter 44, 54 to be substantially equal to a resonant frequency band, selectable from a plurality of resonant frequency bands, which suppresses coupling between the second antenna 28 and any other antenna operating in any one of those selectable resonant frequency bands.

For example, if the first antenna 20 is operable at 1300 MHz and 1500 MHz, the controller 12 may control the first phase shifter 26 to shift the resonant frequency band of the notch filter 44, 54 to be substantially equal to 1300 MHz or 1500 MHz and thereby select which frequency band of the first antenna 20 the second antenna 28 is isolated from.

The combination of the second filter 36 and the third antenna 40 form a notch filter which has a (non radiating) resonant frequency band (e.g. at 850 MHz). In particular, the inductor 48 of the second filter 36 and the capacitor 56 of the third antenna 40 form a notch filter having a resonant frequency band. In the embodiment illustrated in FIG. 2, a signal having a frequency within the resonant frequency band of the notch filter 48, 56 goes to ground via the inductor 48. It should be appreciated that the resonant frequency band of the notch filter 48, 56 may be determined from the inductance value of the inductor 48 and from the capacitance value of the capacitor 56.

The second phase shifter 38 is configured to tune the resonant frequency band of the notch filter 48, 56 to be substantially equal to the first resonant frequency band and thereby suppress coupling between the first antenna 20 and the third antenna 40.

The second phase shifter 38 may be a variable phase shifter which is configured to receive a control signal 34 from the controller 12. In this embodiment, the controller 12 is configured to control the second phase shifter 36 to tune the resonant frequency band of the notch filter 48, 56 to be substantially equal to a resonant frequency band, selectable from a plurality of resonant frequency bands, and thereby suppress coupling between the third antenna 40 and any other antenna operating in any one of those selectable resonant frequency bands.

For example, if the first antenna 20 is operable at 1300 MHz and 1500 MHz, the controller 12 may control the second phase shifter 38 to shift the resonant frequency band of the notch filter 48, 56 to be substantially equal to 1300 MHz or 1500 MHz and thereby select which frequency band of the first antenna 20 the third antenna 40 is isolated from.

Figure 3A:
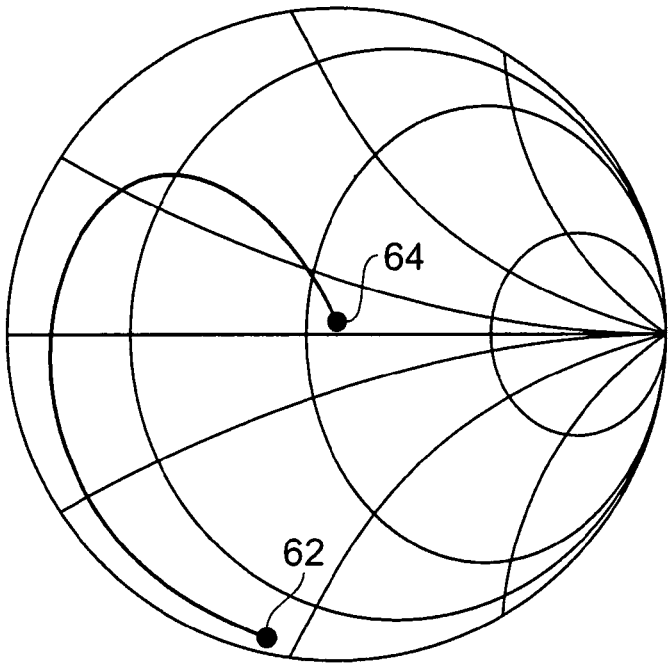
FIG. 3A illustrates a Smith Chart of the impedance of a filter at various frequencies.
Figure 3B:
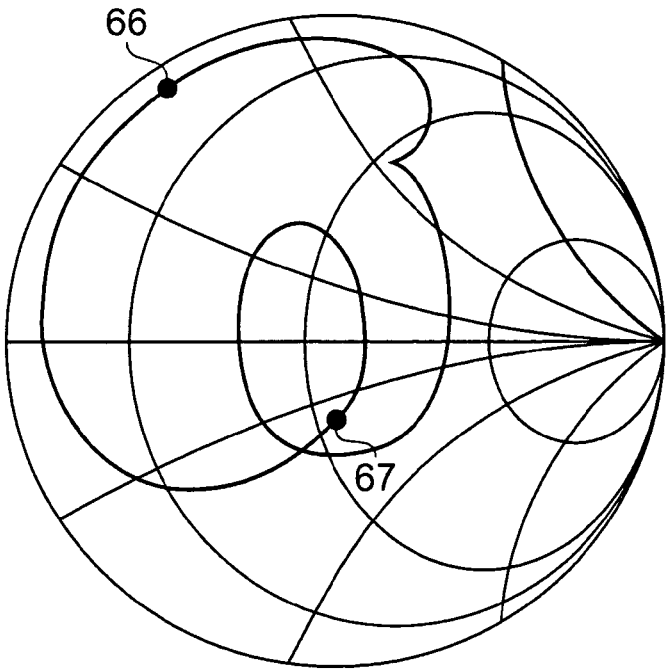
FIG. 3B illustrates a Smith Chart of the impedance of an antenna at various frequencies.

The generation of the non-radiating resonances may also be understood from the Smith Charts illustrated in FIGS. 3A and 3B.

FIG. 3A illustrates a Smith Chart of the impedance of the second filter 36 at various frequencies as measured at the interface between the second filter 36 and the second phase shifter 38. The trace on the Smith Chart commences at position 62 (approximately 850 MHz) which represents an impedance which has low resistance and capacitive reactance. The trace then curls round in a clock wise direction, above the centre line of the Smith Chart and ends at position 64 (approximately 1800 MHz) which represents an impedance having a resistance of substantially fifty ohms and little or no reactance.

FIG. 3B illustrates a Smith Chart of the impedance of the third antenna 40 at various frequencies as measured at the interface between the second phase shifter 38 and the third antenna 40. The trace on the Smith Chart commences at position 66 (approximately 850 MHz) which represents an impedance which has low resistance and inductive reactance. The trace then curls round in a clock wise direction, below the centre line of the Smith Chart and then loops round the centre of the Smith Chart (through three hundred and sixty degrees) and ends at position 67 (approximately 2170 MHz) which represents an impedance having a resistance just above 50 ohms and a relatively small capacitive reactance.

From the Smith Charts illustrated in FIGS. 3A and 3B, it should be appreciated that at the frequency of approximately 850 MHz, the third antenna 40 and the second filter 36 produce a (non radiating) resonance as the overall capacitance of the second filter 36 cancels the overall inductance of the third antenna 40 (i.e. they create a notch filter through complex conjugate matching). The second phase shifter 36 is configured to tune the resonance of the combination to a desired frequency band which results in the third antenna 40 being isolated from another antenna. For example, the second phase shifter 38 may shift the resonance to the first resonant frequency band and thereby cause the third antenna 40 to be isolated from the first antenna 20.

Figure 4:
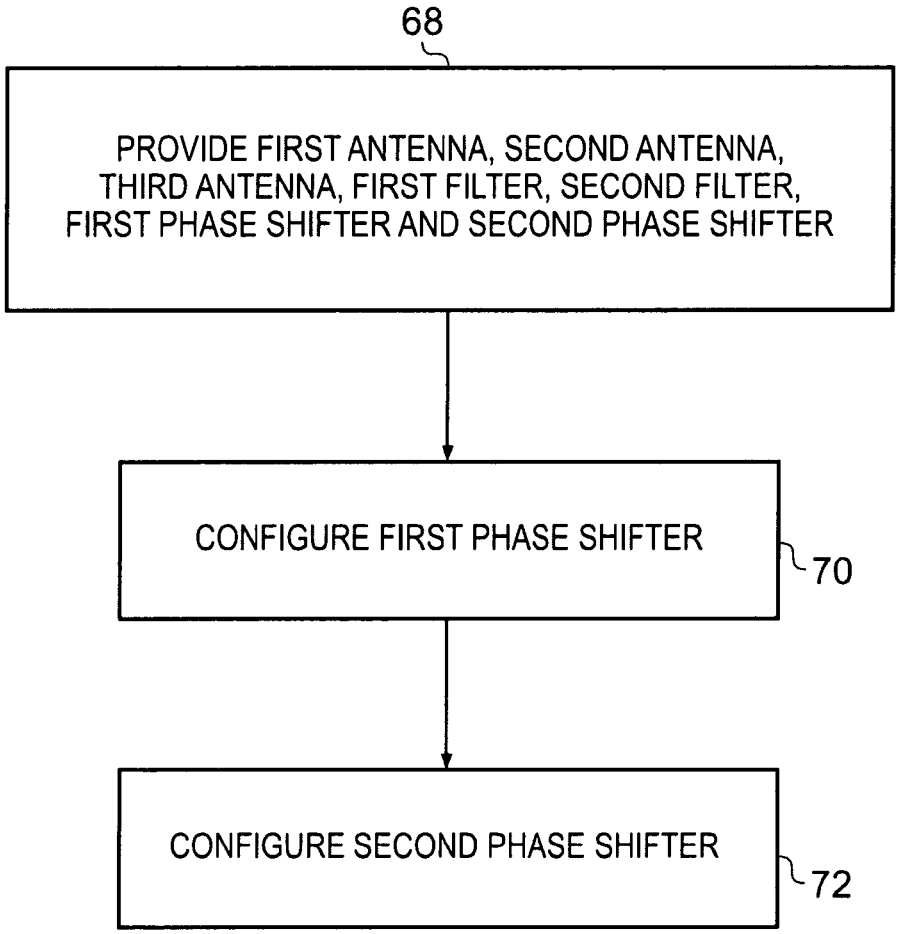
FIG. 4 illustrates a flow diagram of a method of manufacturing an apparatus according to various embodiments of the present invention.

FIG. 4 illustrates a flow diagram of a method of manufacturing an apparatus 10 according to various embodiments of the present invention. At block 68, the first antenna 20, the second antenna 28, the third antenna 40, the first filter 24, the second filter 36, the first phase shifter 26 and the second phase shifter 38 are provided. At block 70, the first phase shifter 26 is configured to provide the combination of at least the first filter 24 and the second antenna 28 with an impedance at the first resonant frequency band which substantially suppresses coupling between the first antenna 20 and the second antenna 28. At block 72, the second phase shifter 38 is configured to provide the combination of at least the second filter 36 and the third antenna 40 with an impedance at the first resonant frequency band which substantially suppresses coupling between the first antenna 20 and the third antenna 40.

Figure 5:
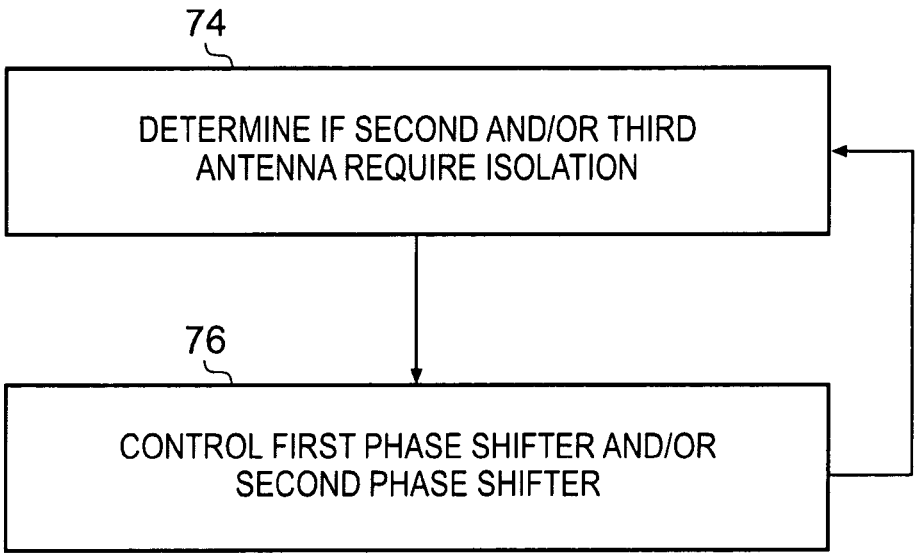
FIG. 5 illustrates a flow diagram of a method of controlling a phase shifter according to various embodiments of the present invention.

FIG. 5 illustrates a flow diagram of a method of controlling a phase shifter 26, 38 according to various embodiments of the present invention. At block 74, the controller 12 determines if the second antenna 28 and/or the third antenna 40 requires isolation at a particular frequency band (e.g. GPS frequencies at 1570.42 MHz to 1580.42 MHz). The controller 12 may determine whether isolation is needed at a particular frequency by measuring reflected power levels in the conductive path between the second and/or third antenna 28, 40 and the second transceiver 22. The controller 12 may also be configured to detect degraded sensitivity by measuring receiver sensitivity (e.g. Received Signal Strength Indication (RSSI)) and determine whether isolation improvement is needed.

If the controller 12 determines that isolation is required, at block 76, the controller 12 controls the first phase shifter 26 and/or the second phase shifter 38 shifter to provide the combination of the first filter 24, second antenna 28 and/or the second filter 36, third antenna 40, with an impedance at a resonant frequency band, selectable from a plurality of resonant frequency bands, which substantially suppresses coupling between the first antenna 20 and the second antenna 28 and/or the third antenna 40 respectively. The method then returns to block 74.

The computer program instructions provide: computer readable program means 15 for controlling a phase shifter to provide a combination of filter and a antenna, coupled to filter, with an impedance at a resonant frequency band, selectable from a plurality of resonant frequency bands, which substantially suppresses coupling between the antenna and another antenna.

The blocks illustrated in the FIG. 5 may represent steps in a method and/or sections of code in the computer program 15. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, the apparatus 10 may include a multiplexer which includes a plurality of antennas connected to a plurality of phase shifters.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a first antenna configured to operate in a first resonant frequency band;

a second antenna configured to operate in a second resonant frequency band;

a first filter coupled to the second antenna; and a first phase shifter configured to provide the combination of at least the first filter and the second antenna with an impedance at the first resonant frequency band which substantially suppresses coupling between the first antenna and the second antenna.

2. An apparatus as claimed in claim 1, wherein the combination of the first filter and the second antenna are configured to form a notch filter having a resonant frequency band, the first phase shifter being configured to shift the resonant frequency band of the combination to be substantially equal to the first resonant frequency band.

3. An apparatus as claimed in claim 1, wherein the first phase shifter is variable and is configurable to provide the combination of the first filter and the second antenna with an impedance at a resonant frequency band, selectable from a plurality of resonant frequency bands, which substantially suppresses coupling between the first antenna and the second antenna.

4. An apparatus as claimed in claim 3, further comprising a controller configured to control the first phase shifter and/or the second phase shifter and to select the resonant frequency band at which coupling between the first antenna and the second antenna, and/or the first antenna and the third antenna respectively is substantially suppressed.

5. An apparatus as claimed in claim 1, further comprising a third antenna configured to operate at a third resonant frequency band, a second filter coupled to the third antenna and a second phase shifter configured to provide the combination of at least the second filter and the third antenna with an impedance at the first resonant frequency band which substantially suppresses coupling between the first antenna and the third antenna.

6. An apparatus as claimed in claim 5, wherein the combination of the second filter and the third antenna are configured to form a notch filter having a resonant frequency band, the second phase shifter being configured to shift the resonant frequency band of the combination to be substantially equal to the first resonant frequency band.

7. An apparatus as claimed in claim 5, wherein the second phase shifter is variable and is configurable to provide the combination of the second filter and the third antenna with an impedance at a resonant frequency band, selectable from a plurality of resonant frequency bands, which substantially suppresses coupling between the first antenna and the third antenna.

8. An apparatus as claimed in claim 5, further comprising a multiplexer including the first filter and the second filter.

9. An apparatus as claimed in claim 5, wherein the second filter is a high pass filter.

10. An apparatus as claimed in claim 1, wherein the first filter is a low pass filter.

11. An apparatus as claimed in any of the preceding claim 1, wherein the first phase shifter is integral with the first filter.

12. An apparatus as claimed in claim 1, wherein the first resonant frequency band is a Global Navigation Satellite System (GNSS) frequency band.

13. An electronic device comprising an apparatus as claimed in claim 1.

14. A method comprising:

providing a first antenna configured to operate in a first resonant frequency band, a second antenna configured to operate in a second resonant frequency band, a first filter coupled to the second antenna, and a first phase shifter; and configuring the first phase shifter to provide the combination of at least the first filter and the second antenna with an impedance at the first resonant frequency band which substantially suppresses coupling between the first antenna and the second antenna.

15. A method as claimed in claim 14, further comprising configuring the combination of the first filter and the second antenna to form a notch filter having a resonant frequency band, the first phase shifter being configured to shift the resonant frequency band of the combination to be substantially equal to the first resonant frequency band.

16. A method as claimed in claim 14, wherein the first phase shifter is variable and the method further comprises configuring the first phase shifter to provide the combination of the first filter and the second antenna with an impedance at a resonant frequency band, selectable from a plurality of resonant frequency bands, which substantially suppresses coupling between the first antenna and the second antenna.

17. A method as claimed in claim 14, further comprising providing a third antenna configured to operate at a third resonant frequency band, a second filter coupled to the third antenna and a second phase shifter; and configuring the second phase shifter to provide the combination of at least the second filter and the third antenna with an impedance at the first resonant frequency band which substantially suppresses coupling between the first antenna and the third antenna.

18. A method as claimed in claim 17, further comprising configuring the combination of the second filter and the third antenna to form a notch filter having a resonant frequency band, the second phase shifter being configured to shift the resonant frequency band of the combination to be substantially equal to the first resonant frequency band.

19. A non-transitory computer-readable storage medium encoded with instructions that, when executed by a processor, perform: controlling a first phase shifter to provide a combination of a first filter and a second antenna, coupled to the first filter, with an impedance at a resonant frequency band, selectable from a plurality of resonant frequency bands, which substantially suppresses coupling between a first antenna and the second antenna.

20. A non-transitory computer-readable storage medium as claimed in claim 19, wherein the first antenna is configured to operate in a first resonant frequency band and the method includes controlling the first phase shifter to provide the combination of the first filter and the second antenna with an impedance at the first resonant frequency band which substantially suppresses coupling between the first antenna and the second antenna.

* * * * *

UNITED STATES PATENT AND TRADEMARK OFFICE

CERTIFICATE OF CORRECTION

PATENT NO. : 8,773,324 B2
APPLICATION NO. : 13/001108
DATED : July 8, 2014
INVENTOR(S) : Ozden et al.

It is certified that error appears in the above-identified patent and that said Letters Patent is hereby corrected as shown below:

In the Claims:

Claim 11, col. 12, line 32 "any of the preceeding" should be deleted.

Signed and Sealed this
Thirtieth Day of September, 2014

Michelle K. Lee

Michelle K. Lee
*Deputy Director of the United States Patent and Trademark Office*